United States Patent [19]

Hanley

[11] Patent Number: 4,872,673

[45] Date of Patent: Oct. 10, 1989

[54] BALANCING BEAM TOY

[76] Inventor: James L. Hanley, 28 Farmingdale Dr., Parsippany, N.J. 07504

[21] Appl. No.: 200,077

[22] Filed: May 27, 1988

[51] Int. Cl.[4] ..... A63F 9/00

[52] U.S. Cl. ..... 273/1 GF; 446/97

[58] Field of Search ..... 273/1 GF; 446/97, 117; 272/54–56, 1 E; 434/262

[56] References Cited

U.S. PATENT DOCUMENTS

| | | | |
|---|---|---|---|
| 211,528 | 1/1879 | Shelton | 446/97 |
| 1,159,261 | 11/1915 | Otto | 272/54 |
| 3,559,989 | 2/1971 | Breslow | 273/1 GF |
| 3,887,179 | 6/1975 | Klepper et al. | 272/1 E |
| 4,303,240 | 12/1981 | Ellman et al. | 273/1 GF |
| 4,356,659 | 11/1982 | Clarke | 446/97 |
| 4,575,345 | 3/1986 | Wager | 434/262 X |

FOREIGN PATENT DOCUMENTS

| | | | |
|---|---|---|---|
| 544200 | 1/1956 | Belgium | 273/1 GF |

OTHER PUBLICATIONS

Montgomery Ward Christmas Catalog, 1965, 12–1965, p. 235, Item #10.

Playthings, vol. 58, No. 6, 6–1960, #7563, Blockhead Game.

*Primary Examiner*—Paul E. Shapiro

[57] ABSTRACT

A balancing toy comprising a base having bearing supports, adapted to accept a balance beam having journals. A figurine comprising a multiplicity of segments is formed by balancing one segment upon the other on the balance beam without causing the balance beam to rotate on its journals. In one embodiment the figurine is in the form of a woodsman and the balance beam represents a log. In another embodiment the balance beam is in the form of a gymnast's balance beam and the figurine is in the form of a gymnast. In a third embodiment the figurine is in the form of a surfer and the beam has the appearance of a surf board.

21 Claims, 3 Drawing Sheets

BALANCING BEAM TOY

FIELD OF THE INVENTION

This invention relates to a balancing toy. In particular, it relates to a balance beam toy which tests the players skill to balance a piece on a beam.

BACKGROUND OF THE INVENTION

Balancing toys are well known in the art. U.S. Pat. No. 2,458,306 discloses a toy comprising a hemisphere the equatorial section of which forms a flat plain upon which the player attempts to balance blocks.

U.S. Pat. No. 3,241,833 discloses a balancing game comprising a table shaped article and numerous chair shaped article to be balanced one upon the other.

U.S. Pat. No. 3,559,989 discloses a game similar to that of U.S. Pat. No. 2,458,306 except that the toy is floated in water.

U.S. Pat. No. 3,567,221 discloses a toy which comprises a board having a centrally located fulcrum integral with the board at its bottom; the board being balance on the fulcrum when a set of weights are evenly distributed on each side of the board.

U.S. Pat. No. 3,614,106 discloses a balance toy comprising a base and a multiplicity of pieces to be balance one above the other. Each play piece has a pair of outwardly extending arms adapted to hold a weight. The weights must be positioned on the arms so as to cause the play piece to be balanced.

U.S. Pat. No. 3,863,918 discloses a balance toy comprising building blocks of various shapes. The object of the game is to stack the blocks one upon the other in an attempt to reach a maximum height.

U.S. Pat. No. 4,589,664 discloses a balancing toy which comprises a board with a central pair of axes provided with a fulcrum and locations for playing pieces on either side of the axes which fall within rows parallel to the axes. Play pieces of different weights are provided to fit in particular locations on each side of the board. The fulcrum is elevated to allow tilting of the board. The game commences with all weights on the board. Opposing players shift the weights to cause the board to tilt in the direction of the opponent.

SUMMARY OF THE INVENTION

A balancing toy comprising a base having bearing supports, adapted to accept a balance beam having journals. A figurine comprising a multiplicity of segments is formed by balancing one segment upon the other on the balance beam with out causing the balance beam to rotate on its journals. In one embodiment the figurine is in the form of a woodsman and the balance beam represents a log. In another embodiment the balance beam is in the form of a gymnast's balance beam and the figurine is in the form of a gymnast. In a third embodiment the figurine is in the form of a surfer and the beam has the appearance of a surf board.

DETAILED DESCRIPTION OF THE INVENTION

This invention relates to a balancing toy. The game comprises a balancing beam rotatably mounted on a journal. The journal is supported by a base having bearing supports adapted to accept the journals. A play piece comprising stackable segments is balanced on the beam. The game can be played by a solitary player who attempts to assemble the figurine on the beam without causing it to tip. In the alternative two or more players take turns balancing alternate segments of the figurine by stacking a subsequent segment on top of a segment previously balanced by a prior player. The game ends when a player causes the figurine to topple in attempting to stack a subsequent segment on the existing portion of the figurine.

The invention may be more readily appreciated by reference to the drawings.

Figure 1A:
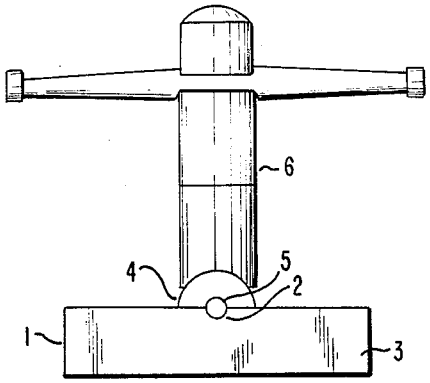
FIG. 1 shows a plan (B) and elevation (A) view of the toy comprising a base, balance beam and figurine.
FIG. 1C shows a pivot point support.
FIG. 1D is an elevation view of a balance beam with internal bearings and fixed journals.
FIG. 1E a bearing surface mounted on a rocker support.
Figure 1B:
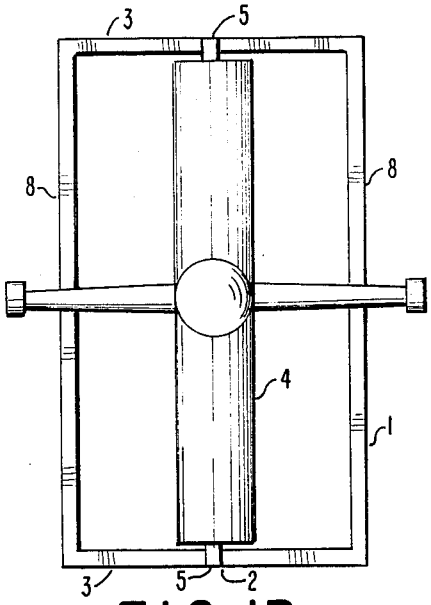

FIG. 1A is an elevation view of the balancing toy showing a figurine balance on the beam. FIG. 1B is a plan view of the toy of this invention. Referring now to FIG. 1, a base is shown, 1, having a bearing surface, 2, in each of two opposing faces, 3, of the base, 1. A balance beam, 4, having a pair of oppositely extending protrusions which form journals, 5, is rotatably mounted on the bearing supports, 2. A figurine, 6, is balanced on the beam, 4. The opposing faces, 3, of the base, 1, can be rigidedly connected by side rails, 8.

Figure 2:
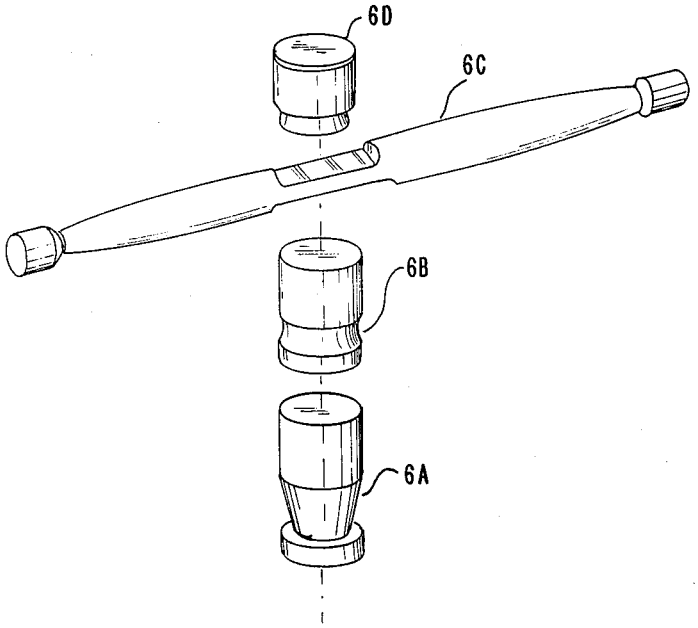
FIG. 2 shows a segmented figurine.

As shown in FIG. 2, the Figurine, 6, is comprised of at least four segments; a leg segment, 6A, a torso segment, 6B, an arm segment, 6C, and a head segment, 6D.

Figure 3:
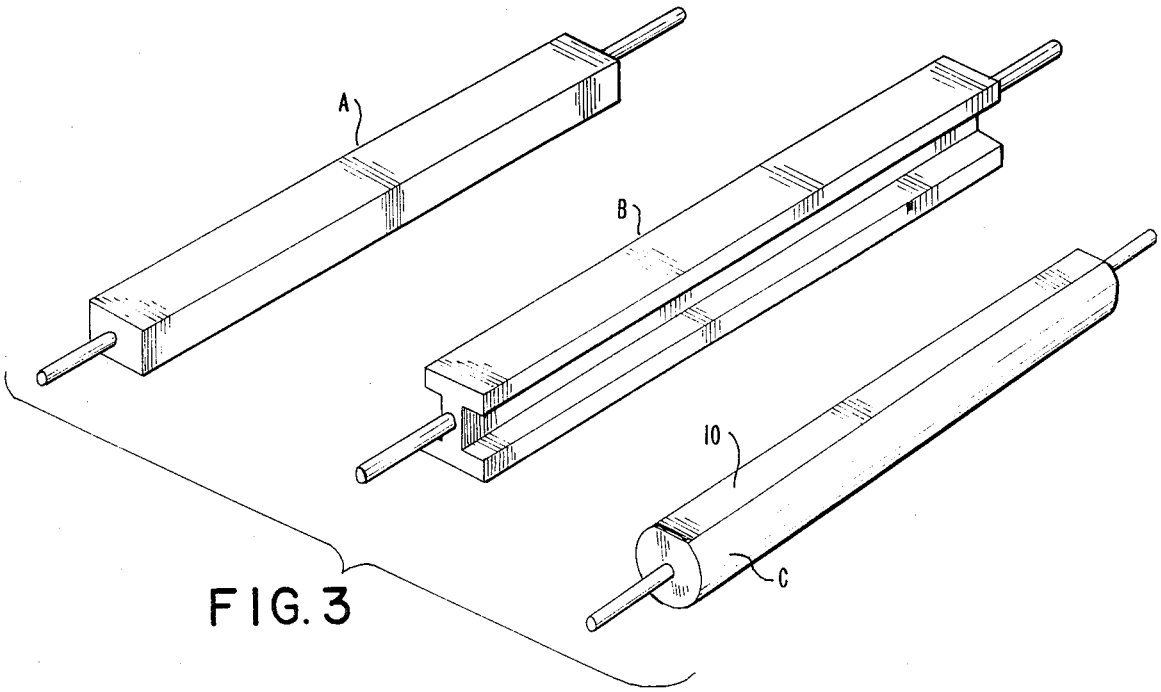
FIGS. 3 and 4 shows various configurations for the balance beams.

FIGS. 3 and 4 show various configurations for the balance beams useful in the toy of this invention. The figurine can be artistically design to have the appearance of various sports participants, e.g., a surfer, a gymnast, a logger or woodsman. The surfer is balanced on a beam, 4, having the appearance of a surf board as shown in FIG. 4B, while the gymnast is used in conjunction with gymnasts balance beam of square cross section as shown in FIG. 3A. The logger figurine is used in conjunction with a beam having a substantially circular cross section. The leg segment of the logger is a concave segment, as shown in FIG. 3A, which mates with the circular cross section of the beam.

In another embodiment of the invention the "log" can have a flat surface, 10, as shown in FIG. 3C not requiring a mating leg segment. In that event the leg segment can have a flat bottom. As used in the specification and claims the term "substantially circular cross-section" as used wit respect to the balance beam means both a circular cross-section and the cross-section of "log" having a flat portion.

Figure 4E:
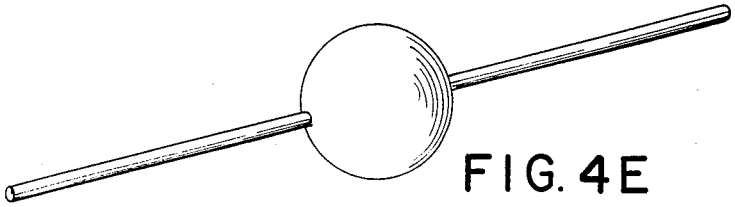
Figure 4D:
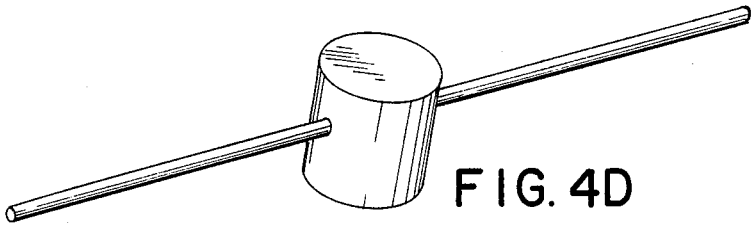
Figure 4C:
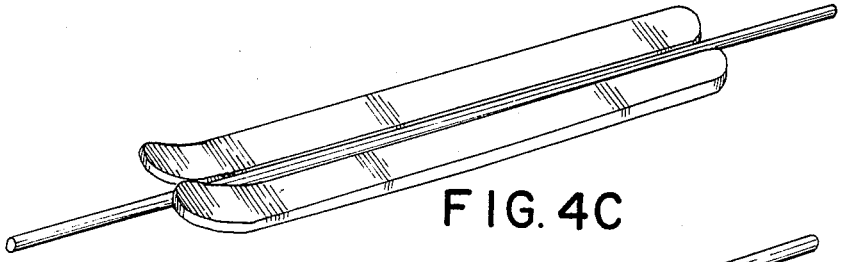
Figure 4B:
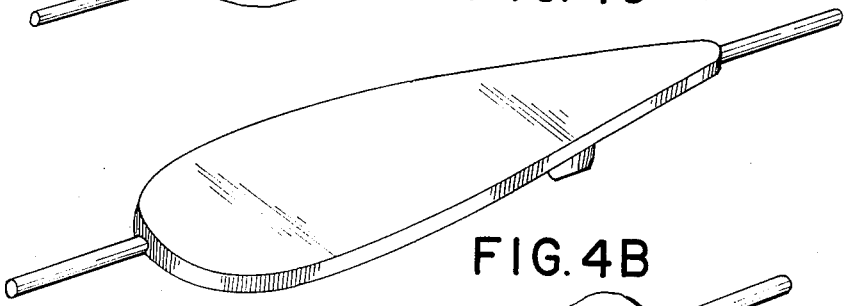
Figure 4A:
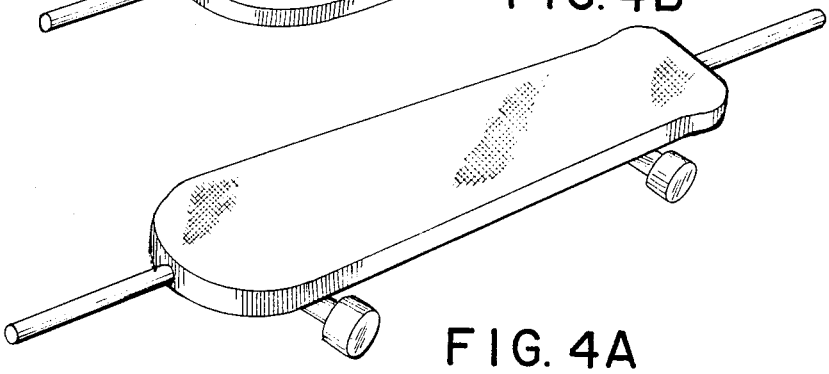

FIG. 3B represents balance beam in the form of an "I" beam used in conjunction with a steel worker figurine. FIG. 4A represents a skate board balance beam, 4C represents a ski balance beam, 4D represents a vertical cylinder balance beam, and 4E beam represents a balance beam in the form of a ball, each of which can be used with an appropriate figurine.

Figure 1C:
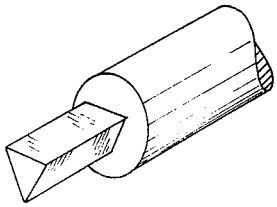
Figure 1D:
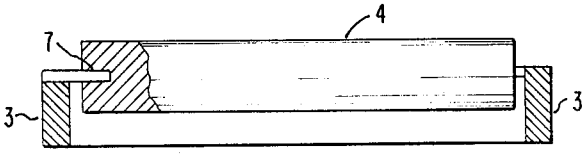

It will be appreciated by those skilled in the art having access to this disclosure that the journals can be rigidly mounted to the base as shown in FIG. 1D, and that the beam can have bearings in each end into which the journals can slide. Optionally, metal bearing surfaces can be inserted into the beam. Where the journal is fixed as in FIG. 1D, side rails are optional and can be detachable from the opposing faces.

In using the balance toy of this invention a single player attempts to assemble the figurine without having it topple as a result of an unbalance created in assembling the figurine. Alternately, two players can each take turns adding segments to the figurine. The player who causes the figurine to topple loses.

It will be appreciated by those skilled in the art having access to this disclosure that the figurine can have more than four segments. Each of the leg, and torso segments can themselves be divided into two or more segments. The head and arm segments can if desired be joined to form a single segment. As used in the specification and claims, the term "segmented figurine means a figurine having at least two segments which can be stacked one upon the other to form the complete figurine. Preferably, the figurine comprises at least 3 segments. The beam itself can be a cylindrical rod in which case the beam and journals merge into a single element.

The sensitivity of the balance beam to imbalance can be controlled by the smoothness of the surface of the journal and the bearing surface. Where the bearing is a smooth hard surface and the journal is a smooth polished surface, the balance beam will turn freely and balancing the figurine will take greater practice and skill. Where the bearing surface is of soft wood and the journal has a knurled surface, there will be greater resistance to rotation and the figurine will be easier to balance.

In one embodiment the bearing surfaces are of wood and a polished metal removable insert is provided for the the bearing. Similarly, the journals can comprise removal rod inserts. One set of rod inserts can be knurled and the other of smooth polished metal. By changing the journal surface and/or the inserts varying degrees of skill levels can be achieved. The lowest skill level would be the combination of the wood bearing and knurled rod inserts. The highest skill level results from the combination of the metal insert bearing surface and the smooth, polished rod insert journals.

It will be appreciated that it is within the skill of those skilled in the art having access to this disclosure to alter the cross sectional shape of the balance beam and the appearance of the figurine without departing from the scope of this invention. Furthermore, the protrusions need not have a rod like shape. They may for example be knife edges as shown in FIG. 1C. In that event the protrusion has a triangular cross section, the apex of which forms the knife edge.

Figure 1E:
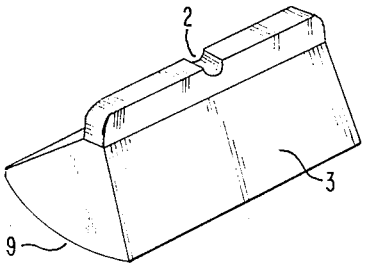

In another embodiment of the invention an additional degree of freedom can be given to the figurine by providing unstable supports. Referring to FIG. 1E the bearing surface, 2, is mounted onto of a rocket support, 9, which taken together comprises one of the opposing faces of the base. Preferably, in this configuration no side rails are used. Where they are used they must be pivotedly mounted to the opposing faces of the base. A higher degree of skill is required to balance the figurine since, in addition to the rotary motion of the beam, the player must content with the rocking motion of the base.

What is claimed is:

1. A balance toy comprising a base, a balance beam rotatably mounted on the base and a segmented figurine.

2. The balance toy according to claim 1 wherein the beam comprises an elongated member having opposing protrusions and the base comprises at least two opposing faces, each face having a bearing surface to accept the beam protrusions.

3. The balance toy according to claim 2 wherein the protrusions are journals and the bearing surface is adapted to accept the journal.

4. The balance toy according to claim 3 wherein the journals are removable from the beam.

5. The balance toy according to claim 3 wherein the journals have a knurled surface.

6. The balance toy according to claim 3 wherein the journals have a smooth surface.

7. The balance toy according to claim 2 wherein the opposing faces of the base have a curved bottom portion thereby permitting the base to rock back and forth on the curved bottom portion.

8. The balance toy according to claim 2 wherein the opposing faces of the base are are connected by side rails.

9. The balance toy according to claim 8 wherein the side rails are rigdedly connected to the opposing faces of the base.

10. The balance toy according to claim 1 wherein the balance beam is in the form of a log and the figurine has the appearance of a woodsman.

11. The balance toy according to claim 1 wherein the balance beam is in the form of a gymnasts balance beam and the figurine has the appearance of a gymnast.

12. The balance toy according to claim 1 wherein the balance beam is in the form of a surf board and the figurine has the appearance of a surfer.

13. The balance toy according to claim 1 wherein the base comprises at least two opposing faces having journals rigidly mounted thereto and the balance beam comprises an elongated member having bearings in opposing ends of the beam adapted to accept the journals.

14. The balance toy according to claim 13 wherein the balance beam is in the form of a log and the figurine has the appearance of a woodsman.

15. The balance toy according to claim 13 wherein the balance beam is in the form of a gymnasts balance beam and the figurine has the appearance of a gymnast.

16. The balance toy according to claim 13 wherein the balance beam is in the form of a surf board and the figurine has the appearance of a surfer.

17. The balance toy according to claim 13 wherein the journals have a knurled surface.

18. The balance toy according to claim 13 wherein the journals have a smooth surface.

19. The toy according to claim 1 wherein the bearing comprises a wood surface.

20. The toy according to claim 19 wherein the bearing is provided with a metal insert.

21. A balance toy comprising a segmented figurine, a base having bearing surfaces and a balance beam having opposing protrusions axially disposed in said beam, said protrusions comprising knife edge surfaces on which the beam is balanced.

* * * * *